US006085547A

United States Patent [19]

Johnston

[11] Patent Number: 6,085,547

[45] Date of Patent: Jul. 11, 2000

[54] SIMPLE METHOD AND APPARATUS FOR THE PARTIAL CONVERSION OF NATURAL GAS TO LIQUID NATURAL GAS

[76] Inventor: Richard P. Johnston, 641 Joe Wheeler Brown Rd., Fulton, Miss. 38843

[21] Appl. No.: 09/157,149

[22] Filed: Sep. 18, 1998

[51] Int. Cl.[7] ..... F25J 1/00

[52] U.S. Cl. ..... 62/613; 62/619

[58] Field of Search ..... 62/611, 613, 619

[56] References Cited

U.S. PATENT DOCUMENTS

| | | | |
|---|---|---|---|
| 3,657,898 | 4/1972 | Ness et al. . | |
| 3,735,600 | 5/1973 | Dowdoll et al. . | |
| 3,818,714 | 6/1974 | Etzbach et al. . | |
| 3,837,172 | 9/1974 | Markbreiter et al. . | |
| 4,033,735 | 7/1977 | Swenson . | |
| 4,139,019 | 2/1979 | Bresie et al. . | |
| 4,213,476 | 7/1980 | Bresie et al. . | |
| 4,215,753 | 8/1980 | Champness . | |
| 4,359,871 | 11/1982 | Strass . | |
| 4,419,114 | 12/1983 | May et al. . | |
| 4,505,722 | 3/1985 | Shelton, Jr. . | |
| 4,566,886 | 1/1986 | Fabian et al. | 62/619 |
| 4,920,749 | 5/1990 | Letarte . | |
| 4,948,404 | 8/1990 | Delong | 62/619 |
| 4,970,867 | 11/1990 | Herron et al. . | |
| 5,003,782 | 4/1991 | Kucerija . | |
| 5,036,671 | 8/1991 | Nelson et al. . | |
| 5,199,266 | 4/1993 | Johansen . | |
| 5,231,835 | 8/1993 | Beddome et al. . | |
| 5,287,703 | 2/1994 | Bernhard et al. . | |
| 5,755,114 | 5/1998 | Foglietta . | |

*Primary Examiner*—Ronald Capossela
*Attorney, Agent, or Firm*—Frost & Jacobs LLP

[57] ABSTRACT

A method and apparatus for the partial conversion of natural gas to liquid natural gas. Natural gas, at a high pressure and free of impurities which would hinder the formation of liquid natural gas, is split into first and second flow portions. The first flow portion is conducted through a first heat exchanger and thereafter through a second heat exchanger. From the second heat exchanger, the first flow portion is throttled into a collector, wherein part thereof flashes to liquid natural gas and a part thereof constitutes a cold saturated vapor to be vented from the collector. The vent remainder serves as a coolant for the second heat exchanger. The second flow portion passes through a restrictor and is thereby cooled. The vent remainder from the second heat exchanger is joined with the cooled second flow portion and this combination serves as a coolant for the first heat exchanger before it is conducted to a receiver.

26 Claims, 2 Drawing Sheets

SIMPLE METHOD AND APPARATUS FOR THE PARTIAL CONVERSION OF NATURAL GAS TO LIQUID NATURAL GAS

REFERENCE TO RELATED APPLICATION

The present invention is related to co-pending application Ser. No. 09/157,026, filed Sep. 18, 1998, in the name of Richard P. Johnston and entitled METHOD AND APPARATUS FOR THE PARTIAL CONVERSION OF NATURAL GAS TO LIQUID NATURAL GAS; and co-pending application Ser. No. 09/157,025, filed Sep. 18, 1998, in the name of Richard P. Johnston and entitled A LIQUID NATURAL GAS SYSTEM WITH AN INTEGRATED ENGINE, COMPRESSOR AND EXPANDER ASSEMBLY, the disclosure of each of which is incorporated herein by reference.

TECHNICAL FIELD

A method and apparatus for a system of producing liquified natural gas, and more particularly to such a system which requires no external power source and no moving parts.

BACKGROUND ART

Prior art workers have devised many types of partial conversion and total conversion systems for the production of liquid natural gas. While these systems work well they are generally rather complex, requiring expensive equipment such as compressors, expanders, prime movers, refrigeration equipment, and the like.

The present invention is directed to a partial conversion system for the production of liquid natural gas which is extremely simple. While the system of the present invention provides a relatively low yield, its advantages lie in the fact that it requires a minimum of equipment, no external power source, and no equipment with moving parts.

Since the system provides a relatively low yield of liquid natural gas, when compared to systems which are more complex and which require expensive equipment, the use of the system of the present invention would be a matter of economic decision and would also depend on the nature of the natural gas source. For example, the use of the system of the present invention would be advantageous in a high pressure well head environment, or where there is a significant let-down in gas supply pressure.

DISCLOSURE OF THE INVENTION

According to the invention there is provided both a method and an apparatus for a partial conversion system for the production of liquid natural gas. The system is associated with a source of high pressure natural gas sufficiently free of impurities which would interfere with the formation of liquid natural gas. The flow of natural gas from the source is split into first and second flow portions. The first flow portion is conducted through a first heat exchanger. Thereafter, the first flow portion is conducted through a second heat exchanger. From the second heat exchanger, the first flow portion is throttled by means of a restrictor into a collector wherein part thereof flashes to liquid natural gas and a part thereof constitutes a cold saturated vapor to be vented from the collector through the second heat exchanger as the coolant therefor.

The second flow portion passes through a restrictor and is thereby cooled. The vent remainder from the second heat exchanger is joined with the cooled second flow portion and this combination is used as a coolant for the first heat exchanger. The combined second flow portion and vent remainder are thereafter conducted to a receiver.

DETAILED DESCRIPTION OF THE INVENTION

Figure 1:
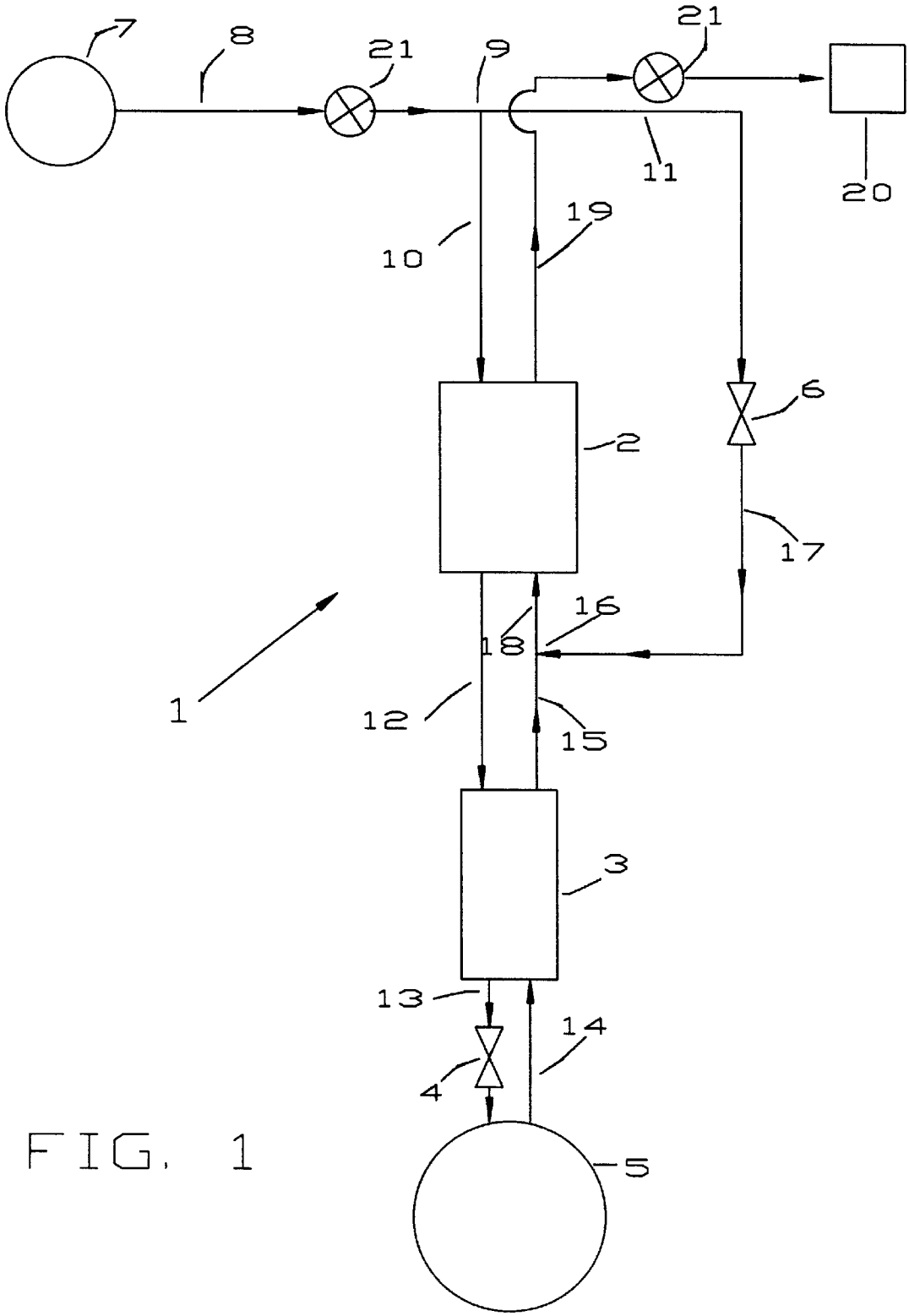
FIG. 1 is schematic representation of the present invention.

In FIG. 1, the overall system of the present invention is generally indicated at 1. The apparatus, per se, is extremely simple. The apparatus comprises a first heat exchanger 2, a second heat exchanger 3, a first pressure reducer 4, a collector 5, a second pressure reducer 6, and interconnecting conduits to be described. The system depends on the Joule Thompson cooling effect derived from a sudden pressure drop through a restrictor.

The system 1 is connected to a source 7 of high pressure, clean natural gas. As used herein and in the claims, the reference to high pressure natural gas refers to natural gas at a pressure high enough to produce an economic yield of liquid natural gas. Again, as used herein and in the claims, the term clean natural gas refers to natural gas which is sufficiently free of those impurities which would tend to clog the apparatus or otherwise interfere with the formation of liquid natural gas. If the source 7 is a well head, a purifier (not shown) will probably have to be provided to cleanse the natural gas.

The high pressure flow from source 7 is conducted by conduit 8 to point 9. At point 9, flow from the source is split into two flow portions. The flow portions are determined to optimize the heat exchanger cooling process for heat exchangers 2 and 3. The first flow portion is conducted from point 9 by conduit 10. The second flow portion is conducted from point 9 by conduit 11.

The first flow portion is conducted by conduit 10 to a first heat exchanger 2. From heat exchanger 2, the first flow portion is conducted by conduit 12 to the second heat exchanger 3. It will be understood that heat exchangers 2 and 3 can constitute any appropriate type of heat exchanger. Excellent results are achieved when the heat exchangers 2 and 3 are of the cross-counterflow type, as is well known in the art.

The pressure reducer 4 is normally referred to in the art as a throttle or restrictor. Herein and in the claims, the element 4 will be referred to as a restrictor. The same is true for restrictor 6. Restrictors 4 and 6 preferably comprise adjustable throttle valves.

Figure 2:
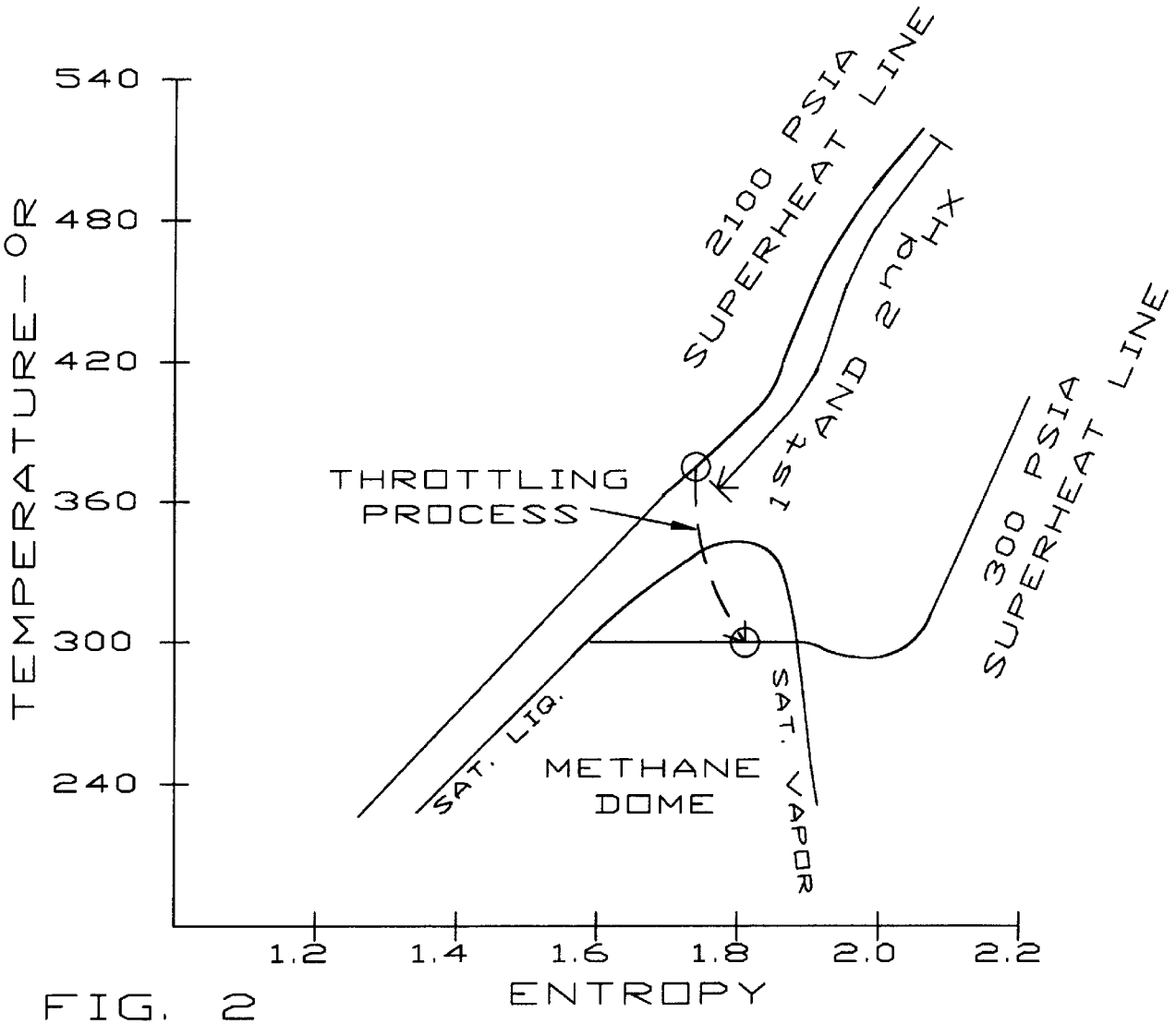
FIG. 2 is a generic methane liquification diagram for the described process.

The first flow portion from the second heat exchanger 3 is conducted by conduit 13 to restrictor 4. Restrictor 4 throttles the first flow portion to a pressure low enough to pass through the saturated liquid/vapor dome as shown in the methane liquification diagram of FIG. 2. Part of the first natural gas flow portion flashes to liquid natural gas. The unliquified vent remainder of the first flow portion constitutes a cold, saturated, natural gas vapor at a sufficient pressure that it can be directed by conduit 14 to second heat exchanger 3 wherein the vent remainder of the first flow portion serves as cooling medium for second heat exchanger 3. From second heat exchanger 3, the vent remainder is conducted by conduit 15 to point 16 to be described hereinafter.

From point 9, the second flow portion of the source flow is conducted by conduit 11 through restrictor 6 which causes it to be cooled. From restrictor 6, the second flow portion is conducted by conduit 17 to point 16. At point 16, the second flow portion and the vent remainder of the first flow portion are combined and conducted by conduit 18 to first heat exchanger 2, wherein they serve as the coolant medium. From the first heat exchanger 2, the combined second flow portion and vent remainder are conducted by conduit 19 to an appropriate lower pressure downstream receiver 20. Any appropriate type of receiver may be used. For example, the receiver may comprise a gas pipeline, a pump inlet, the inlet of a gas turbine, the inlet of a chemical process, a burner head, or the like. It is important that the combined second flow portion and the vent remainder carried in conduit 19 are at a pressure equal to or greater than that of receiver 20.

In an exemplary description of the operation of system 1 it will be assumed for purposes of an exemplary showing that the gas from the source has a pressure of about 2100 psia and a temperature of 70° F. (530° R). Both heat exchangers are assumed to have an effectiveness of 0.90. At point 9, 48.5 percent of the source flow enters conduit 10 and 51.5 percent of the source flow enters conduit 11. This split is chosen to optimize the cooling process. The first flow portion, having passed through the first heat exchanger, remains at a pressure of about 2100 psia and is at a temperature of −19° F. (441° R). Having passed through the second heat exchanger 3, the first flow portion is still at a pressure of about 2100 psia and is at a temperature of −65° F. (395° R). Having passed through restrictor 4, 31.2 percent of the original source flow constitutes the very cold natural gas vapor vent return portion. The pressure within the collector 5 and thus the pressure of the vent return gas is at about 300 psia and at a temperature of −159.7° F. (300.3° R).

When the vent return gas passes through the second heat exchanger 3, serving as a coolant therefore, it exits the second heat exchanger 3 at a pressure of about 300 psia and a temperature of −33° F. (427° R).

The second flow portion, after passing through restrictor 6, is at a pressure of about 300 psia and a temperature of −26.5° F. (433.5° R). The vent remainder and the cooled second flow portion combine at point 16 and serve as the coolant for first heat exchanger 2. These combined gases have a temperature of −29° F. (431° R) in conduit 18, and a pressure of about 300 psia. In conduit 19, after passing through the first heat exchanger 2, these combined gases have a temperature of 60.1° F. (520.1° R) and a pressure of about 300 psia. The combined vent remainder and second flow portion constitute 82.7 percent of the original source flow. The combined vent remainder and second flow portion are at a pressure of about 300 psia which is assumed to be equal to or greater than the pressure of the receiver 20. Thus, system 1 in this exemplary showing converted about 17.3 percent of the source flow into liquid natural gas.

It will be understood that parameters of temperature, pressure and the like given above are exemplary only. These parameters will change depending upon the temperature and pressure of the well head or other source, the nature of the receiver, the efficiency of the equipment and other related factors. To adjust these parameters to maximize the production of liquid natural gas is well within the skill of the worker in the art.

The maintenance of proper flows and pressure levels throughout the embodiment of the system of the present invention depends entirely on the existence of stable inlet and exhaust pressures and flows. This stability requirement can be alleviated to some extent by the judicious placement of pressure regulators in addition to the variable restrictors 4 and 6. These pressure regulators can be used to eliminate the process variability due to uncontrolled upstream and downstream pressure fluctuations. Such pressure regulators are shown in FIG. 1 at 21 and are preferably adjustable.

When purification of the gas is required, this can be accomplished in a number of ways. First of all, purifier equipment could be located in conduit 8 to thoroughly clean the source flow before it is split at 9. Another approach would be to locate purifier equipment in line 8 to partially purify the source flow to remove any impurities which might clog the apparatus. A second and more thorough purifier treatment can be applied to the first flow portion to remove those impurities which would interfere with the formation of liquid natural gas. Alternatively, it would be possible to apply a thorough purifier treatment to the first flow portion from which the liquid natural gas is derived, and to subject the second flow portion to a lesser purifying treatment, primarily removing those impurities which might clog the apparatus.

Although the invention has been described in terms of the partial conversion of natural gas to liquid natural gas, the invention is applicable to the partial liquification of other appropriate gases.

Modifications may be made in the invention without departing from the spirit of it.

What is claimed is:

1. A method for the partial conversion of natural gas to liquid natural gas comprising the steps of providing a flow source of high pressure natural gas, a first heat exchanger, a second heat exchanger, a first restrictor, a second restrictor, a collector and a receiver, splitting said source flow into a first flow portion and a second flow portion, conducting said first flow portion through said first heat exchanger, conducting said first flow portion through said second heat exchanger, conducting said first flow portion to said first restrictor, throttling said first flow portion into said collector wherein part of said first flow portion flashes to liquid natural gas and the remainder constitutes a cold saturated vapor, venting said remainder from said collector, conducting said vent remainder through said second heat exchanger as the cooling medium therefor, conducting said second flow portion through said second restrictor to be cooled thereby, combining said vent remainder from said second heat exchanger and said cooled second flow portion and conducting said combined gases through said first heat exchanger as the cooling medium therefor, and conducting said combined gases to said receiver.

2. The method claimed in claim 1 including the steps of reducing the pressure of said first flow portion and the pressure of said second flow portion to values at least equal to the pressures of said receiver.

3. The method claimed in claim 1 wherein said first and second restrictors comprise throttle valves.

4. The method claimed in claim 1 wherein said source gas is sufficiently free of those impurities which would interfere with the formation of liquid natural gas.

5. The method claimed in claim 1 including the step of purifying said gas from said source so that said source gas is sufficiently free of those impurities which would interfere with the formation of liquid natural gas.

6. The method claimed in claim 1 including the steps of clearing said first flow portion of those impurities which would clog said heat exchangers or otherwise interfere with the formation of liquid natural gas, and cleaning said second flow portion of those impurities which would tend to clog said heat exchangers and said restrictors.

7. The method claimed in claim 1 including the steps of locating a first purifier between said source and said split point to clean said source flow of impurities which might clog said heat exchangers and restrictors and providing a second purifier to clean said first flow portion of impurities which interfere with the formation of liquid natural gas.

8. The method claimed in claim 1 including the steps of locating a first purifier so as to clean said first flow portion of impurities which may clog said heat exchangers and restrictors and those impurities which would otherwise interfere with the formation of liquid natural gas, and locating a second purifier so as to clean said second flow portion of clogging impurities.

9. An apparatus for converting a fraction of the natural gas from a pressurized flow source thereof to liquid natural gas, said flow source being connected to a point where said flow from said source is split into first and second flow portions, a first heat exchanger, said first flow portion from said split point being connected to said first heat exchanger, a second heat exchanger, said first heat exchanger being connected to said second heat exchanger, a first restrictor, said second heat exchanger being connected to said first restrictor, a collector, said restrictor being connected to said collector such that said first flow portion of said source natural gas passes through and is cooled by said first and second heat exchangers and is throttled by said first restrictor into said collector wherein it partially flashes to liquid natural gas with the remainder comprising a cold saturated natural gas vapor, said collector being vented to said second heat exchanger and said second heat exchanger being connected to a second point such that said remainder in said collector pass through said second heat exchanger, serving as a coolant therefor and thereafter passes to said second point, a second restrictor, said second flow from said first point is connected to said second restrictor and is cooled thereby, said second restrictor is connected to said second point where said vent remainder from said second heat exchanger is combined with said cooled second flow portion, said second point is connected to said first heat exchanger, a receiver, said first heat exchanger is connected to said receiver such that said combined gases pass through said first heat exchanger constituting a coolant therefor and thereafter flow to said receiver.

10. The apparatus claimed in claim 9 wherein said combined vent remainder and second flow portion have a pressure at least equal to that of said receiver.

11. The apparatus claimed in claim 9 wherein said first and second restrictors comprise throttle valves.

12. The apparatus claimed in claim 9 wherein said source gas is sufficiently free of those impurities which would interfere with the formation of liquid natural gas.

13. The apparatus claimed in claim 9 including a purifier located between said source of natural gas and said split point whereby to render said source gas sufficiently free of those impurities which would interfere with the formation of liquid natural gas.

14. The apparatus claimed in claim 9 including a first purifier immediately following said split point to clean said first flow portion of those impurities which may clog said apparatus and would otherwise interfere with the formation of liquid natural gas, and a second purifier immediately following said split point to clean said second flow portion of impurities which might clog the apparatus.

15. The apparatus claimed in claim 9 including a first purifier between said source and said split point to clean said source flow of impurities which might clog the apparatus, and a second purifier positioned to clean said first flow portion of impurities which interfere with the formation of liquid natural gas.

16. A method for converting a fraction of natural gas from a source to liquid natural gas, comprising the steps of:

a. providing a flow of pressurized natural gas having an initial pressure;

b. passing a first portion of said flow through at least a first heat exchanger to cool said first portion of said flow;

c. reducing the pressure of said first portion of said flow thereby flashing a first part of said first portion of said flow to liquid natural gas, leaving a second part of said first portion of said flow which comprises a saturated natural gas;

d. reducing the pressure of a second portion of said flow by passing said second portion through a restrictor, thereby cooling said second portion of said flow;

e. passing said second portion of said flow and said second part of said first portion of said flow through said at least a first heat exchanger to serve as a cooling medium therefor.

17. The method claimed in claim 16 comprising the step of combining said second portion of said flow with said second part of said first portion of said flow prior to the step of passing said second portion of said flow and second part of said first portion of said flow through said at least a first heat exchanger.

18. The method claimed in claim 16 including the steps of:

a. passing said first portion of said flow through at least a second heat exchanger after said first portion of said flow has passed through said at least a first heat exchanger, prior to the step of reducing the pressure of said first portion of said flow;

b. passing said second part of said first portion of said flow through said at least a second heat exchanger prior to the step of passing said second portion of said flow through said at least a first heat exchanger.

19. The method claimed in claim 18 comprising the step of combining said second portion of said flow with said second part of said first portion of said flow prior to the step of passing said second portion of said flow and second part of said first portion of said flow through said at least a first heat exchanger.

20. The method claimed in claim 16, 17, 18 or 19 including the step of determining respective flow rates of said first and second portions of said flow a. by the relationship between said initial pressure of said flow and the respective pressures of said second part of said first portion of said flow and of said second portion of said flow after the step of passing said second portion through said at least a first heat exchanger, b. by the properties of the liquid natural gas, c. by optimization of the heat exchange process, and d. by the thermodynamic efficiency of said at least a first heat exchanger and of said step of reducing the pressure of said second portion of said flow through said restrictor.

21. The method claimed in claim 16, 17, 18 or 19 including the step of removing unwanted constituents from said flow of pressurized natural gas.

22. The method claimed in claim 16, 17, 18 or 19 wherein the step of reducing the pressure of said first portion of said flow includes passing said first portion of said flow through a throttle valve.

23. The method claimed in claim 16, 17, 18 or 19 wherein said at least a first heat exchanger is of the cross-counter flow type.

24. The method claimed in claim 16, 17, 18 or 19 wherein said restrictor comprises a throttle valve.

25. The method claimed in claim 16, 17, 18 or 19 wherein said step of reducing the pressure of said second portion of said flow includes reducing the pressure of said second portion of said flow to a pressure equal to or greater than the pressure of said second part of said first portion of said flow.

26. The method claimed in claim 16, 17, 18 or 19 wherein said flow of pressurized natural gas comes from a well head.

* * * * *